US005952921A

United States Patent [19]

Donnelly

[11] Patent Number: 5,952,921

[45] Date of Patent: Sep. 14, 1999

[54] MISPLACED GOLF CLUB REMINDER

[76] Inventor: Mark Lewis Donnelly, 7313 Abbington Ct., Frederick, Md. 21702

[21] Appl. No.: 09/102,112

[22] Filed: Jun. 22, 1998

[51] Int. Cl.[6] ..... G08B 13/14

[52] U.S. Cl. ..... 340/568.6; 340/571; 340/572.1

[58] Field of Search ..... 340/568.6, 571, 340/572.1, 539

[56] References Cited

U.S. PATENT DOCUMENTS

| | | | |
|---|---|---|---|
| 3,270,564 | 9/1966 | Evans | 340/539 |
| 3,988,724 | 10/1976 | Anderson | 340/539 |
| 4,675,656 | 6/1987 | Narcisse | 340/539 |
| 5,001,461 | 3/1991 | Vroom et al. | 340/568.6 |
| 5,119,072 | 6/1992 | Hemingway | 340/573.4 X |
| 5,289,163 | 2/1994 | Perez et al. | 340/539 |
| 5,616,832 | 4/1997 | Nauck | 73/65.03 |
| 5,844,483 | 12/1998 | Boley | 340/568.6 |

FOREIGN PATENT DOCUMENTS

| | | | |
|---|---|---|---|
| 176339 | 8/1987 | Japan | 340/571 |
| 2279170 | 12/1994 | United Kingdom | 340/571 |

*Primary Examiner*—Thomas Mullen
*Attorney, Agent, or Firm*—Joseph J. Zito

[57] ABSTRACT

A system for alerting a golfer when the golfer has moved too far away from his golf club. One or more clubs are provided with transmitters which transmit on a specific frequency and may contain digital encoding. A common receiver is used to detect the signal from one or a plurality of transmitters. When the distance between the transmitter, attached to the golf club, and the receiver, carried with the golfer, is greater than a threshold distance, the receiver provides an alert to the golfer. The present invention can also include an audible or visual signal associated with the club to assist the golfer in locating the club when he returns to retrieve the club.

20 Claims, 4 Drawing Sheets

MISPLACED GOLF CLUB REMINDER

BACKGROUND OF THE INVENTION

The present invention relates to reminder devices for altering an individual when an item has been misplaced or forgotten. More specifically the invention aids golfers in reducing the time for retrieval of misplaced clubs and in limiting the number of lost clubs.

During a round of golf, a golfer uses a number of different clubs to address the various obstacles and situations which arise. It is not uncommon for a golfer to remove more than a single club from the golfer's bag when considering how best to approach a shot. It is also common for a golfer to temporarily place a club on the ground when raking a sand trap, replacing a divot, holding a flag, watching a drive or lining up a shot. If the golfer neglects to retrieve the club, the club can become misplaced. These and other common practices in a round of golf can lead to the misplacement of a golf club.

Often, especially in the case of a certain club such as a pitching wedge, sand wedge or putter, the loss of the club may go unnoticed until the golfer has moved ahead several holes or even perhaps finished the round. This can cause frustration in retracing the golfers progress through the course and can even lead to the permanent loss of valuable clubs.

SUMMARY OF THE INVENTION

It is an object of the present invention to reduce frustration and the likelihood of a lost golf club by providing an early reminder in the event that a golfer neglects to timely retrieve his club before moving on.

It is another object of the present invention to provide an audible and or visual reminder when a golfer has moved away from a club or clubs, before the golfer has moved too far from the club.

In order to minimize the likelihood of recovery of a club and to reduce the time necessary for retrieval, it is necessary to alert the golfer of the missing club timely. Alerting the golfer before he or she has proceeded through other greens means that the golfer will quickly remember the location of the neglected club. This allows quick retrieval, causing minimal interruption to the golfer's game and the games of the golfer's group.

The present invention includes an RF transmitter located in the golf club and a corresponding RF receiver carried by the golfer, either worn on the golfer's clothing, hooked to the golfer's bag or to the golf cart. The RF receiver/transmitter pair is distance sensitive so that an alarm is triggered if the two are not in sufficiently close proximity. A golfer is therefore reminded quickly if he or she has walked away from a golf club left on a golf course.

A low powered RF transmitter within the club will provide sufficient signal strength for proximity detection by the receiver and allow for minimal weight. The receiver transmitter pair can be preset to alert at a generally acceptable distance such as 100 to 200 feet separation. Alternatively, the receiver can be adjustable so that the individual golfer can set the separation alarm distance.

A golfer may wish to protect more than one club. The golfer can carry a transmitter/receiver pair for each club. Each individual pair would be set to a different frequencies so as to avoid interference. The frequencies can be preset and the transmitter and receiver marked with the frequency, or the transmitter and receiver can be provided with a selector to change frequencies. The ability to change frequencies will also allow a golfer to ensure that his transmitter/receiver pair does not interfere with the devices of other golfers.

Further embodiment of the present invention provides for the alert and retrieval of multiple clubs. Each club is provided with a separate transmitter. In one embodiment, a single receiver is used. The receiver detects the combined signal strength of all of the clubs transmitters. Once at least one club is out of range causing the combined signal strength to fall below a predetermined value, the receiver signals an alert.

In another embodiment, a single receiver with multiple channels is used to individually detect each club transmitter. The multiple channels can be different RF frequencies or can be different digital codes on a common frequency. A golfer can protect his entire bag of clubs with a single receiver. Also, one receiver could be used by a group of golfers to protect one or more clubs of each golfer. The system would have a single receiver and a plurality of transmitters with different frequencies or digital codes. A foursome could place the common receiver in a golf cart or on one of the golfers bags. Each golfer could attach a transmitter to each club to be protected. The alert range would be set to allow the golfers to leave the cart with a club, however, when the cart is moved to the next green, any golfers would be alerted to any clubs left behind.

In a further embodiment, the club can optionally be provided with an audible and or visual signal device. The device can be activated by the golfer when the golfer returns to locate the club. The audible and or visual signal can assist the golfer on club location.

BRIEF DESCRIPTION OF THE DRAWINGS

For a better understanding of the nature of the present invention, reference is had to the following figures and detailed description, wherein like elements are accorded like reference numerals, and wherein.

DETAILED DESCRIPTION OF PREFERRED EXEMPLARY EMBODIMENTS

Figure 1:
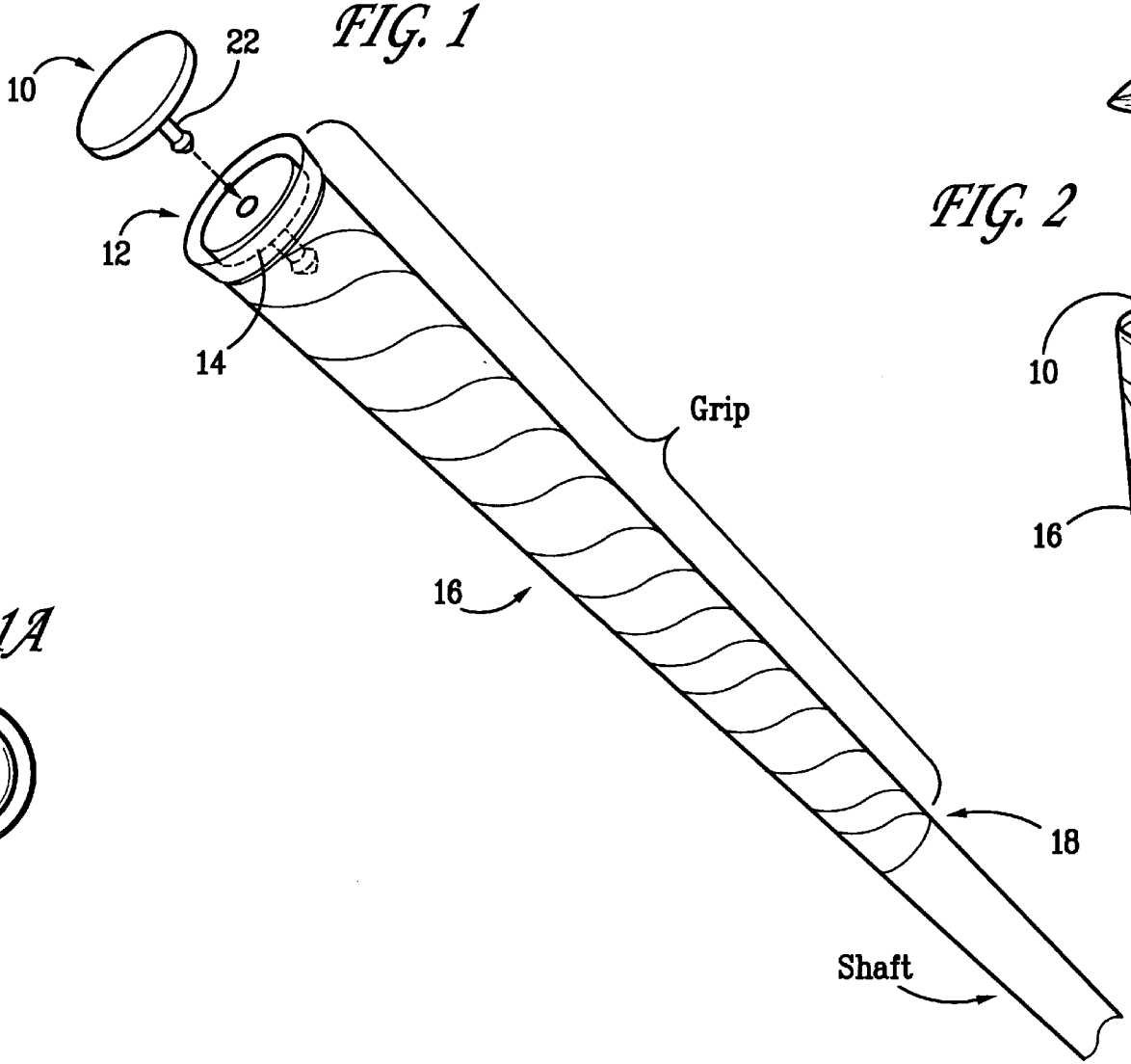
FIG. 1 is a perspective assembly view of a golf club grip with the present invention.
Figure 1A:
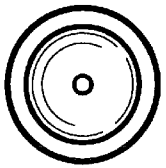

As illustrated in FIG. 1, the present invention includes a transmitter chip 10, which is shaped for mounting in a recessed cavity 12 with a securing hole 14 formed in the end of the grip portion 16 of a golf club 18. After the chip 10 is secured in the recessed cavity 12, a protector plug 20 can be added to protect the chip from dirt and damage.

The chip 10 of the first embodiment has a post 22 formed into the body of the chip 10. The post 22 is configured to secure the chip 10 into the recess 12 by engaging the securing hole 14.

Figure 2:
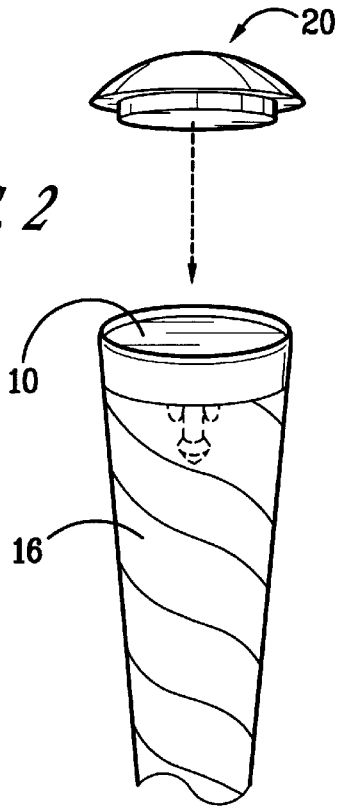
FIG. 2 is a side cross sectional view of a golf club grip with the resent invention mounted in the end of the grip.

As illustrated in FIG. 2, the cavity 12 allows the chip to be recessed with the grip 16 to reduce the likelihood of accidental dislodging of the chip. The removable plug 20 and chip 10 allow for replacement of the batteries for the chip and/or replacement of the entire chip in the event of loss of power or malfunction of the chip.

Figure 3:
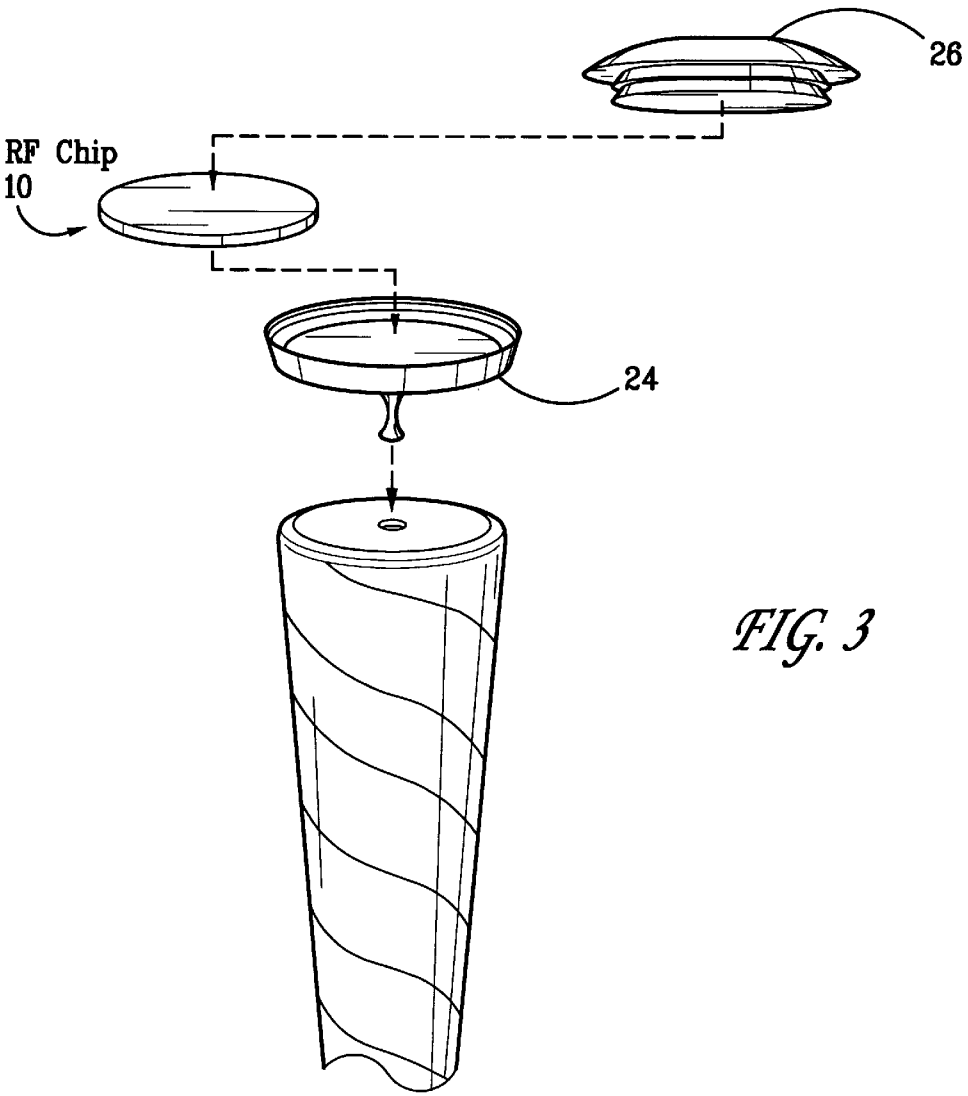
FIG. 3 is a perspective view of a second embodiment of the present invention.

Alternatively, as illustrated in FIG. 3, the chip 10 can be flat disc shaped. The flat chip 10 rests in a mounting holder 24 which is secured to the end of the grip 16. The mounting holder includes a protective end cap 26 for securing and protecting the chip. The holder can be constructed of metal, plastic, resin, fiberglass, composite or other suitable material.

Figure 4:
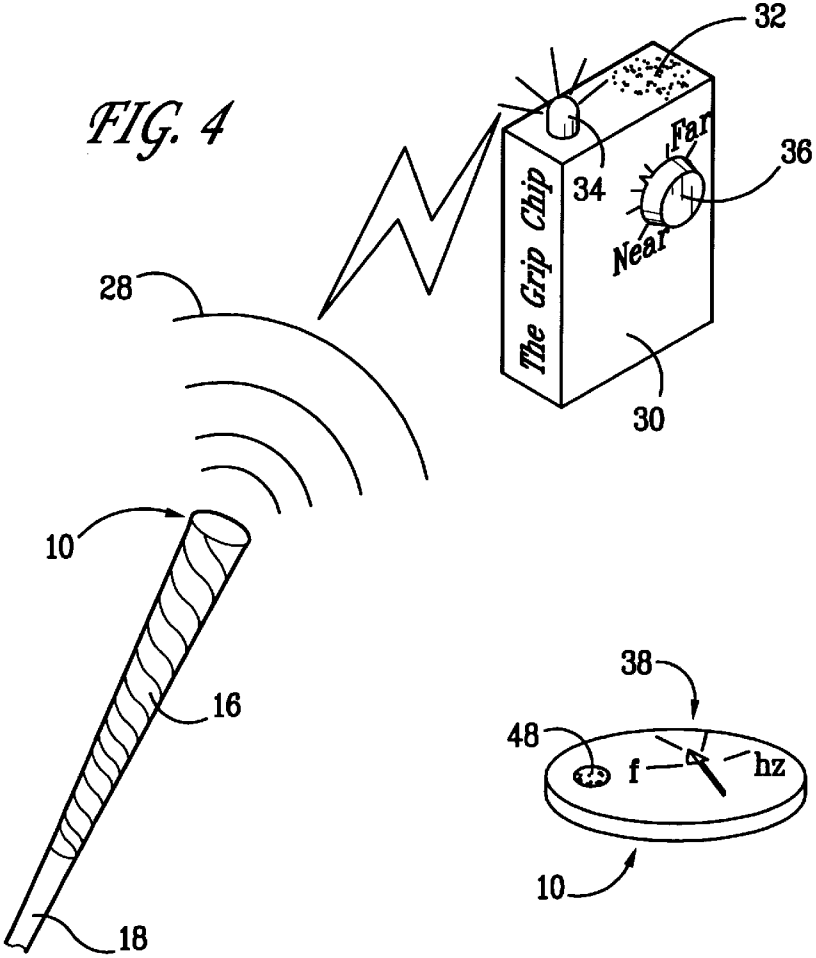
FIG. 4 illustrates the transmitter and receiver in communication.

As illustrated in FIG. 4, the chip 10 within the grip 16 of club 18 produces an RF signal 28. The RF signal 28 is detected by receiver 30. Receiver 30 includes circuitry for determining the signal strength of the detected RF signal 28. The receiver 30 compares the determined signal strength to an internal reference signal level. If the signal strength is within an acceptable level, the receiver does not trigger an alert. If the determined signal is below an acceptable level, the receiver alert is triggered. The alert can include an audible signal produced by an appropriate audible signal generator 32 and/or a visual signal produced by an LED or other light source 34.

The receiver 30 detects the signal strength of the transmitter 10 and determines an approximate distance based on the signal strength level. The internal reference signal level can be preset to approximate an average travel distance for an average golfer under average conditions. This will yield acceptable alert results the majority of times for most users. Although the detected signal strength will vary due to distance between the transmitter 10 and the receiver 30, the signal strength can also be affected by obstacles, interference, battery strength and other factors.

As an alternative embodiment, the receiver 30 can be provided with an optional adjustment 36 allowing the user to adjust the internal reference signal to the golfer's preference. To adjust the alert separation distance, the user adjusts the detection threshold through adjustment 36. This can be used to compensate for the presence of interference, to allow for greater or lesser travel away from the club and to compensate for reduced signal strength as a result of reduced battery power.

Figure 5:
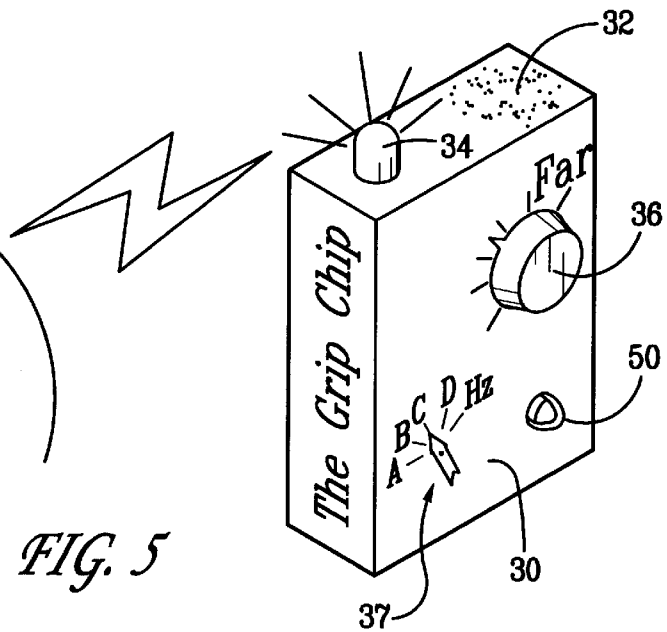
FIG. 5 illustrates a frequency and or code adjustable receiver/transmitter pair.

The receiver 30 and transmitter 10 can optionally be provided with frequency designators or digital code designators 37 and 38, FIG. 5. The frequency designators 37, 38 allow the user to select the RF frequency of the transmitter/receiver pair, by controlling internal circuitry. The code designators 37, 38 allow the user to select the matching digital code of the transmitter/receiver pair, by controlling internal circuitry. This allows for an individual golfer to carry more than one transmitter/receiver pair without interference and allows the golfer to avoid interference with transmitters or receivers of other golfers.

In a further embodiment, the present invention can also include an audible or visual signal associated with the club to assist the golfer in locating the club when he returns to retrieve the club. Receiver 10 or club 16 can optionally be provided with an audible and or visual signal device 48. The device 48 can be activated by the golfer from button 50 on transmitter 30 when the golfer returns to locate the club 16. The audible and or visual signal can assist the golfer on club location.

Figure 6:
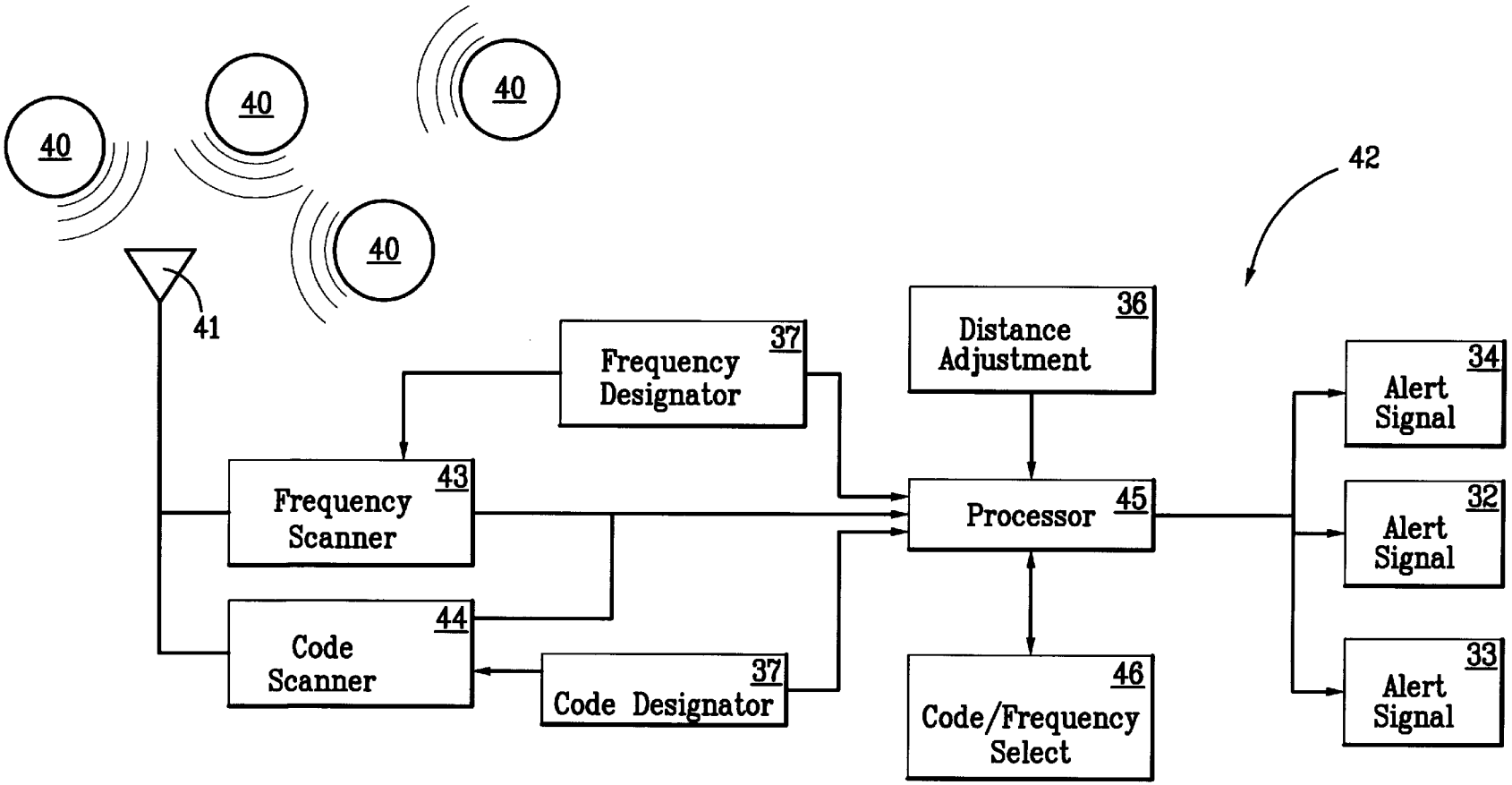
FIG. 6 is a functional block diagram of a multiple transmitter, single receiver system of the present invention.

In FIG. 6, a number of transmitters 40 are utilized to track a number of individual clubs. The receiver 42 monitors the status of all clubs by scanning the appropriate frequencies 43 or by checking for the appropriate digital codes 44 to determine if all of the transmitters 40 are within range. The receiver 42 can be equipped with either frequency scanner circuitry 43 or code scanning circuitry 44 or both.

The signals from the transmitters 40 are received by antenna 41. The signal is then processed by the appropriate scanning circuitry 43/44 and sent to the receiver processor 45. Optional threshold adjustment 36 provides a reference signal level to processor 35 to allow for user selection of the desired distance separation from the club transmitter 40. Code/frequency selector 46 allows for selection of input from either the code scanner or the frequency scanner if both are present in the receiver 42. Additionally, code or frequency specifier 37 allows the user to designate particular frequencies or particular codes to match the transmitter/receiver pairs so that the receiver will recognize the appropriate clubs and ignore signals from other clubs.

When the processor 45 detects that the signal from one of the monitored transmitters 40 falls below the desired level, indicating that the distance between the transmitter and the receiver has exceeded a maximum distance, the processor activates the appropriate alert signal 32, 33 and/or 34. These signals can be audible or visual as discussed above or can be a signal 33 which is indicative of the particular misplaced club by display of identifying indicia.

Alternatively, and within the scope of the invention, the distance between transmitter and receiver can be detected by methods other than signal strength. Because many varying and different embodiments may be made within the scope of the inventive concept herein taught, and because many modifications may be made in the embodiments herein detailed in accordance with the descriptive requirements of the law, it is to be understood that the details herein are to be interpreted as illustrative and not in a limiting sense.

I claim:

1. Golf club monitoring apparatus, comprising:

an RF transmitter adapted for mounting in the grip portion of a golf club, a corresponding RF receiver, including circuitry for producing an alert signal when said transmitter and said receiver are separated by a distance greater than a predetermined threshold distance.

2. The monitoring apparatus of claim 1, wherein:

said receiver includes mounting means for selectively attaching said receiver to a golfer's clothing, to a golf bag or to a golf cart.

3. The monitoring apparatus of claim 1, wherein:

said transmitter is shaped for mounting in a recessed cavity formed in the end of the grip portion of a golf club.

4. The monitoring apparatus of claim 3, wherein:

said transmitter includes an elongated extension shaped for secure engagement with a corresponding securing hole formed in said recessed cavity.

5. The monitoring apparatus of claim 4, further including:

a protector plug for covering said transmitter within said recessed cavity.

6. The monitoring apparatus of claim 1, further including:

a mounting holder shaped for mounting in a recessed cavity formed in the end of the grip portion of a golf club, wherein:

said transmitter is shaped for mounting within said mounting holder.

7. The monitoring apparatus of claim 6, further including:

an elongated extension on said mounting holder shaped for secure engagement with a corresponding securing hole formed in said recessed cavity and a cap for covering said transmitter within said holder.

8. The monitoring device of claim 1, wherein:

said transmitter is a low powered RF transmitter, and said receiver detects the RF signal to determine if the transmitter is in sufficiently close proximity based upon received signal strength.

9. The monitoring apparatus of claim 8, wherein:

said signal strength detection is set to a preset value to approximate a standard acceptable separation.

10. The monitoring apparatus of claim 8, further including:

means for adjusting said signal strength detection.

11. The monitoring apparatus of claim 1, further including:

means for adjusting said threshold distance.

12. The monitoring apparatus of claim 1, further including:

a frequency selector associated with said transmitter to select an RF frequency for said transmitter, and a frequency selector associated with said receiver to select a corresponding RF frequency for said receiver.

13. The device of claim 1, wherein said transmitter further includes an audible and/or visual signal device and said receiver includes means for activation of said signal device.

14. A golf club monitoring system, comprising:

a plurality of RF transmitters adapted for mounting in the grip portion of golf clubs, each RF transmitter having a distinctive signal, an RF receiver, including first circuitry for receiving and individually distinguishing the RF signal from each of said transmitters, and second circuitry for producing an alert signal when any one or more of said transmitters are separated by a distance greater than a predetermined threshold distance from said receiver.

15. The monitoring apparatus of claim 14, further including:

means for adjusting said threshold distance.

16. The system of claim 14, wherein:

each of said transmitters transmits on a distinct frequency, and said first circuitry distinguishes said transmitters based upon said distinct frequency.

17. The system of claim 14, wherein:

all of said transmitters transmits on a common frequency and each of said transmitters transmits a unique identifier code, and said first circuitry distinguishes said transmitters based upon said unique identifier code.

18. The system of claim 14, wherein:

each of said transmitters transmits on a distinct frequency, and each of said transmitters transmits a unique identifier code, and said first circuitry distinguishes said transmitters based upon said distinct frequency and based upon said unique identifier code.

19. The system of claim 18, further including:

a selector for controlling said first circuitry to selectively distinguish said transmitters only on either said distinct frequency or said unique code.

20. A golf club monitoring system, comprising:

a plurality of RF transmitters adapted for mounting in the grip portion of golf clubs, an RF receiver, including first circuitry for receiving RF signals from said plurality of transmitters, second circuitry for determining the combined signal strength of said received signals and third circuitry for producing an alert signal when said combined signal strength falls below a predetermined value.

* * * * *